US005140906A

United States Patent [19]

Little, II

[11] Patent Number: 5,140,906

[45] Date of Patent: Aug. 25, 1992

[54] AIRBAG IGNITER HAVING DOUBLE GLASS SEAL

[75] Inventor: David J. Little, II, Collegeville, Pa.

[73] Assignee: ICI Americas, Inc., Wilmington, Del.

[21] Appl. No.: 788,046

[22] Filed: Nov. 5, 1991

[51] Int. Cl.[5] ..... F42C 19/12

[52] U.S. Cl. ..... 102/202.14; 102/202.5; 102/202.9; 102/530

[58] Field of Search ..... 102/202, 202.5, 202.7, 102/202.8, 202.9, 202.14, 530, 531

[56] References Cited

U.S. PATENT DOCUMENTS

| | | | |
|---|---|---|---|
| 2,872,870 | 2/1959 | Gey | 102/202 |
| 3,101,669 | 8/1963 | Gatley et al. | 102/202.9 |
| 3,134,329 | 5/1962 | Zeman | 102/202.5 |
| 3,175,492 | 6/1962 | Reyne et al. | 102/202.5 |
| 4,103,619 | 8/1978 | Fletcher et al. | 102/202.2 |
| 4,110,813 | 8/1978 | Hoheisel et al. | 102/202.9 |
| 4,249,673 | 2/1981 | Katoh et al. | 102/530 |
| 4,261,263 | 4/1981 | Coultas et al. | 102/202.2 |
| 4,267,567 | 5/1981 | Nygaard et al. | 102/202.5 |
| 4,271,453 | 6/1981 | Yajima et al. | 102/202.9 |
| 4,378,738 | 4/1983 | Proctor et al. | 102/202.7 |
| 4,422,381 | 12/1983 | Barrett | 102/202.14 |
| 4,592,280 | 6/1986 | Shores | 102/202.14 |
| 4,616,565 | 10/1986 | Reinovsky | 102/202.7 |
| 4,690,063 | 9/1987 | Granier et al. | 102/530 |
| 4,959,011 | 9/1990 | Nilsson | 102/202.5 |
| 5,054,395 | 10/1991 | Vetter et al. | 102/202.9 |

*Primary Examiner*—Charles T. Jordan
*Attorney, Agent, or Firm*—Howson & Howson

[57] ABSTRACT

An airbag igniter having an initiator charge in an inner case and an output charge in a surrounding outer case, has a first metal header closing the inner case and a glass seal providing feed through of one or more electrical connections to the initiator charge through the first header. The outer case has a second metal header fitted to it. The second header surrounds the first header in a spaced relationship maintained by a second glass seal. The second glass seal electrically isolates the second header and outer case from the inner header for protection against accidental ignition. The dual glass seals provide protection against maloperation due to gas leakage. A ceramic washer in axial compression between the outer header and a flange of the inner header provides added assurance against failure of the second glass seal.

8 Claims, 2 Drawing Sheets

AIRBAG IGNITER HAVING DOUBLE GLASS SEAL

BRIEF SUMMARY OF THE INVENTION

This invention relates to pyrotechnic devices, and more particularly to improvements in igniters for use in automotive air bag systems.

A typical air bag igniter is an electroexplosive device used to initiate a sodium azide-based propellant charge for inflation of the air bag. The igniter generally comprises an initiator charge which is in direct contact with a bridgewire. The bridgewire is connected between two contacts which are connectable to a firing circuit. When the bridge wire is electrically heated, it ignites the initiator charge. An output charge or "booster" charge, ignitable by the initiator charge, may be used to effect quick ignition of the sodium azide-based propellant without damaging the propellant grains.

Electrical connections are typically made to the firing circuit respectively from the initiator case and from a central conductor which is in coaxial relationship with the case and extends into the case through an insulator. Devices using this form of electrical connection are known as "coaxial" devices. Alternatively, electrical connections can be made through a pair of parallel, spaced conductors both of which extend into the interior of the initiator case through an insulator. Devices having this form of electrical connection are known as "twinaxial" devices.

In one form of igniter, the initiator charge is contained in an inner case, while the output charge is contained in a surrounding outer case connected electrically to the inner case. This provides a self-contained igniter unit containing both the initiator charge and the booster charge.

One of the problems encountered in the manufacture, installation and use of airbag igniters is the problem of protection against accidental ignition resulting from static electricity. A substantial static charge can accumulate on a worker's body, for example by the rubbing of leather soles of the worker's shoes on a nylon carpet. This accumulated static charge can be discharged as a spark through the initiator material in an igniter, from the case to the firing circuit, when the igniter is touched, or when an ungrounded conductor in contact with the igniter is touched.

To prevent unintended ignition from occurring as a result of static discharge through the pyrotechnic material in the igniter, the case of the igniter may be connected electrically to the firing circuit. This allows the energy of the static charge to be dissipated in a low resistance connection, through the firing circuit, from the igniter case to the automobile body. In a coaxial device, the initiator case is normally connected to the firing circuit. In one form of twinaxial device, one of the two parallel conductors is connected electrically to the initiator case in order to provide a path for dissipation of static energy through the firing circuit. Alternatively, a spark gap may be provided between the case and one of the conductors to allow discharge of static electricity through the spark gap rather than through the pyrotechnic charge.

Preferably, in a device in which the igniter case is electrically connected to the firing circuit, the igniter case is designed so that it does not directly contact the automobile body. For example, the case may be provided with a non-conductive cover made of a plastics material. In the case of a single pole-switched firing circuit, this construction eliminates the possibility of a short circuit if the polarity of the D.C. supply to the firing circuit is accidentally reversed. It also eliminates the possibility of accidental firing, which could occur if the firing circuit supply polarity is reversed, the output leads of the firing circuit are also accidentally interchanged, and the case of the igniter touches the automobile body. Isolation of the case from the automobile body also makes it possible to use a two pole-switched firing circuit.

Constructing the device in such a way as to isolate the igniter case from the automobile body introduces the possibility of leak paths for high pressure gas generated by the propellant. Production of the plastic-covered case also requires an expensive insert molding operation.

Among the objects of this invention are the provision of a simple and easily manufactured form of igniter; inherent protection against accidental firing as a result of static discharge; prevention of unintended firing due to wiring errors; easy mounting; high structural strength; prevention of gas leakage through the igniter; and applicability both to coaxial and twinaxial igniters.

The igniter in accordance with the invention, comprises inner and outer cases, the inner case containing an initiator charge and being closed by a first metal header having a through passage for one or more electrical conductors and a glass seal, and the outer case being closed by a second metal header, surrounding the first header, with a glass seal between the first and second headers, so that the outer case and second header are electrically isolated from the inner case and first header. The outer header provides a mounting flange for the igniter.

The preferred form of the igniter comprises an initiator charge; an inner cup partially enclosing the initiator charge and having an opening; a bridge wire in contact with the initiator charge; a first header fitting the opening of the inner cup, and having a through passage; and means providing a pair of conductors for connecting the bridge wire to a firing circuit. At least one of these conductors extends through the passage of the first header and outward beyond the header. The igniter further comprises first glass sealing means in the header passage for maintaining the conductors in spaced relationship to each other, and for maintaining at least one of the conductors in spaced relationship to the first header. An electrical connection is provided between the first header and the other one of the conductors. An outer cup of electrically conductive material surrounds the inner cup and has a central opening and at least one discharge opening. An electrically non-conductive lining is provided in the outer cup, covering each discharge opening in the outer cup. An electrically conductive second header fits the central opening of the outer cup. The second header includes a mounting flange, and surrounds and is spaced from the first header. Second glass sealing means seals the space between the first and second headers.

The use of dual glass seals isolates the outer case electrically from the inner case and from the firing circuit, and, at the same time, eliminates possible leak paths for the high pressure gas generated by combustion of the propellant composition.

In a preferred embodiment of the invention, the first header comprises a generally cylindrical body having a central axis. The header body surrounds the header passage and has a radially outwardly extending annular flange overlying, and axially spaced from, the second header. An annular ceramic washer fits between, and is in contact with, the annular flange and the first header.

The periphery of the annular flange is preferably in contact with the electrically non-conductive lining of the outer cup.

Further objects, advantages and details of the invention will be apparent from the following detailed description, when read in conjunction with the drawings.

DETAILED DESCRIPTION

Figure 1:
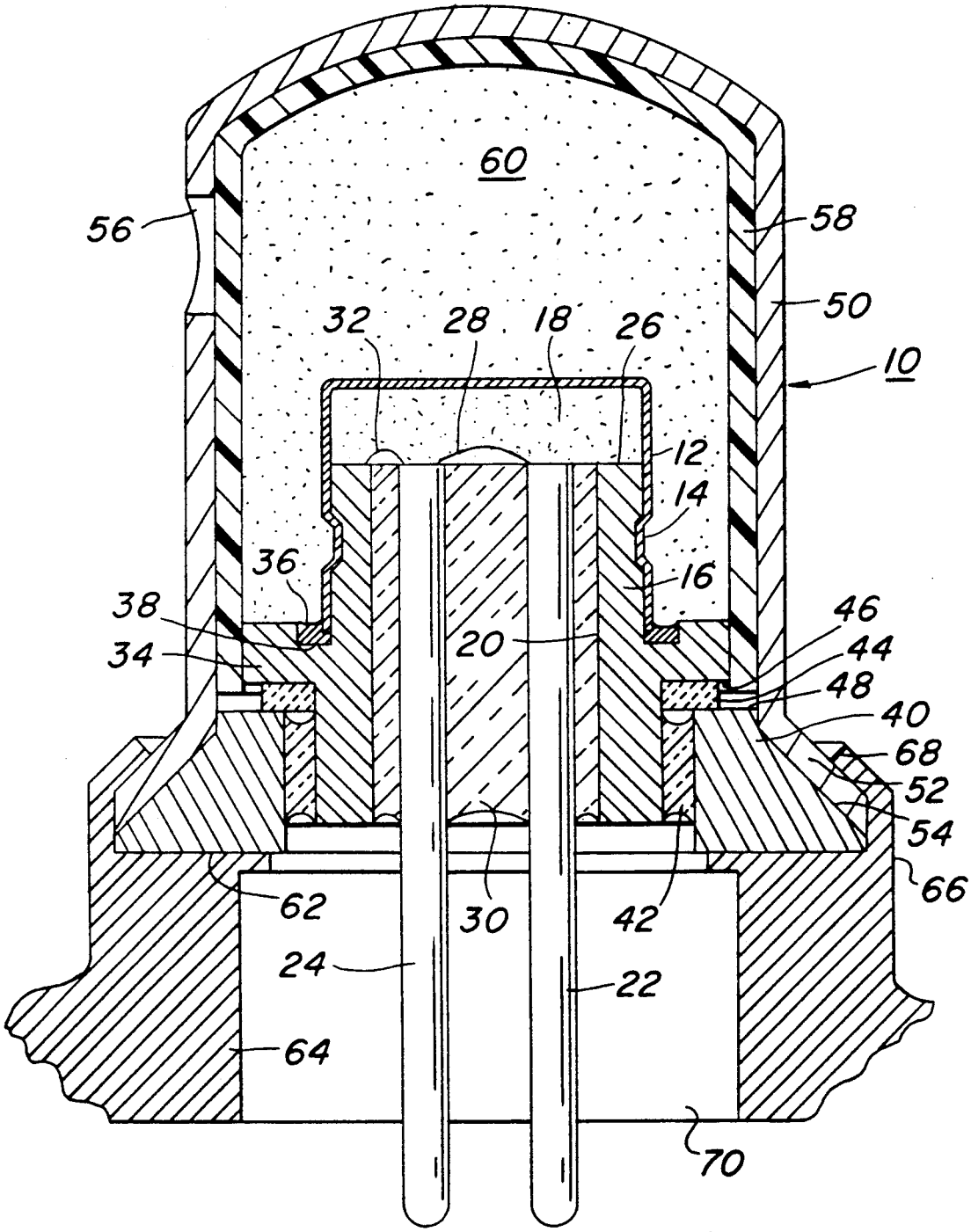
FIG. 1 is an axial section of an igniter of the twinaxial type, constructed in accordance with the invention.

In FIG. 1, a twinaxial igniter 10 comprises an inner case consisting of a metal cup 12 crimped at 14 to a metal inner header 16. An initiator charge 18, typically a mixture of titanium or zirconium powder and potassium perchlorate, is contained within cup 12 in the space above header 16.

The header has a cylindrical central through passage 20, in which two parallel conductors 22 and 24 extend, terminating at the upper surface 26 of the header. The conductors are connected by a bridge wire 28, which is in contact with the initiator charge. Bridge wire 28 is the wire which is heated by current from the firing circuit to ignite the initiator charge. Conductors 22 and 24 are maintained in spaced relationship with each other, and with the wall of passage 20 by a glass seal 30.

A second bridge wire 32 is connected between conductor 24 and header 16 to provide a static discharge path between header 16 and the firing circuit through conductor 24. The use of the second bridge wire is convenient for this purpose, but alternative forms of electrical connection between header 16 and conductor 24 can be used.

Header 16 has an outwardly extending annual flange 34. An annular solder seal 36, in groove 38 on the upper side of the flange, physically seals the enclosure for initiator charge 18 and also ensures electrical connection between cup 12 and header 16.

An annular second header 40 surrounds a portion of header 16 below flange 34. An annular second glass seal 42 is provided between headers 16 and 40. This second glass seal provides electrical isolation between the two headers, and, at the same time, provides a secure physical connection between the two headers. A ceramic washer 44 is provided between the lower surface 46 of flange 34 and the upper surface 48 of header 40. This ceramic washer, which is in compression between flange 34 and header 40, strengthens the assembly, and insures against failure of glass seal 42 as a result of the large axial forces imparted to headers during ignition.

A metal outer cup 50 has a tapered flange 52 at its main opening. This flange is spot welded to a frusto-conical outer surface 54 of header 40. It is provided with a plurality of radial output holes, one of which is shown at 56. A plastic liner 58 is provided on the interior wall of cup 50. This plastic liner closes the radial output holes and contains an output or "booster" charge 60. The output charge is typically a mixture of powdered titanium and boron mixed with potassium perchlorate. The function of the output charge is to ignite the sodium azide propellant quickly without damaging the propellant grains.

The lower end of liner 58 is tightly held between the periphery of flange 34 and the inner wall of cup 50. This prevents the output charge from escaping into the space between flange 34 and header 40 and causing electrical conduction between the two headers.

The frusto-conical shape of outer surface 54 of header 40, and the flat bottom 62 of header 40, allows header 40 to be mounted on a base 64. In installation of the device header 40 fits into a cylindrical space defined by a thin upstanding annulus 66 formed on the base. The upper edge 68 of the annulus is then crimped over tapered flange 52 to hold the igniter firmly in place on the base, with its conductors 22 and 24 extending through opening 70 in the base.

The above-described device is an easily mounted, self-contained, two-component igniter having a number of advantageous features. By virtue of annular glass seal 42, outer cup 50 is electrically isolated from the firing circuit, so that wiring reversals cannot cause accidental ignition. The electrical isolation of the inner case from the outer case also makes it possible to use two-pole switching for added safety. Static protection is afforded by the electrical connections between cup 12 and header 16 and between header 16 and conductor 24. Glass seal 30 provides hermetically sealed feed through for electrical conductors 22 and 24, and the use of the dual glass seals 30 and 42 prevents maloperation of the airbag inflation system due to gas leakage through the igniter assembly. The ceramic washer provides added strength and insures against failure of the outer glass seal.

Figure 2:
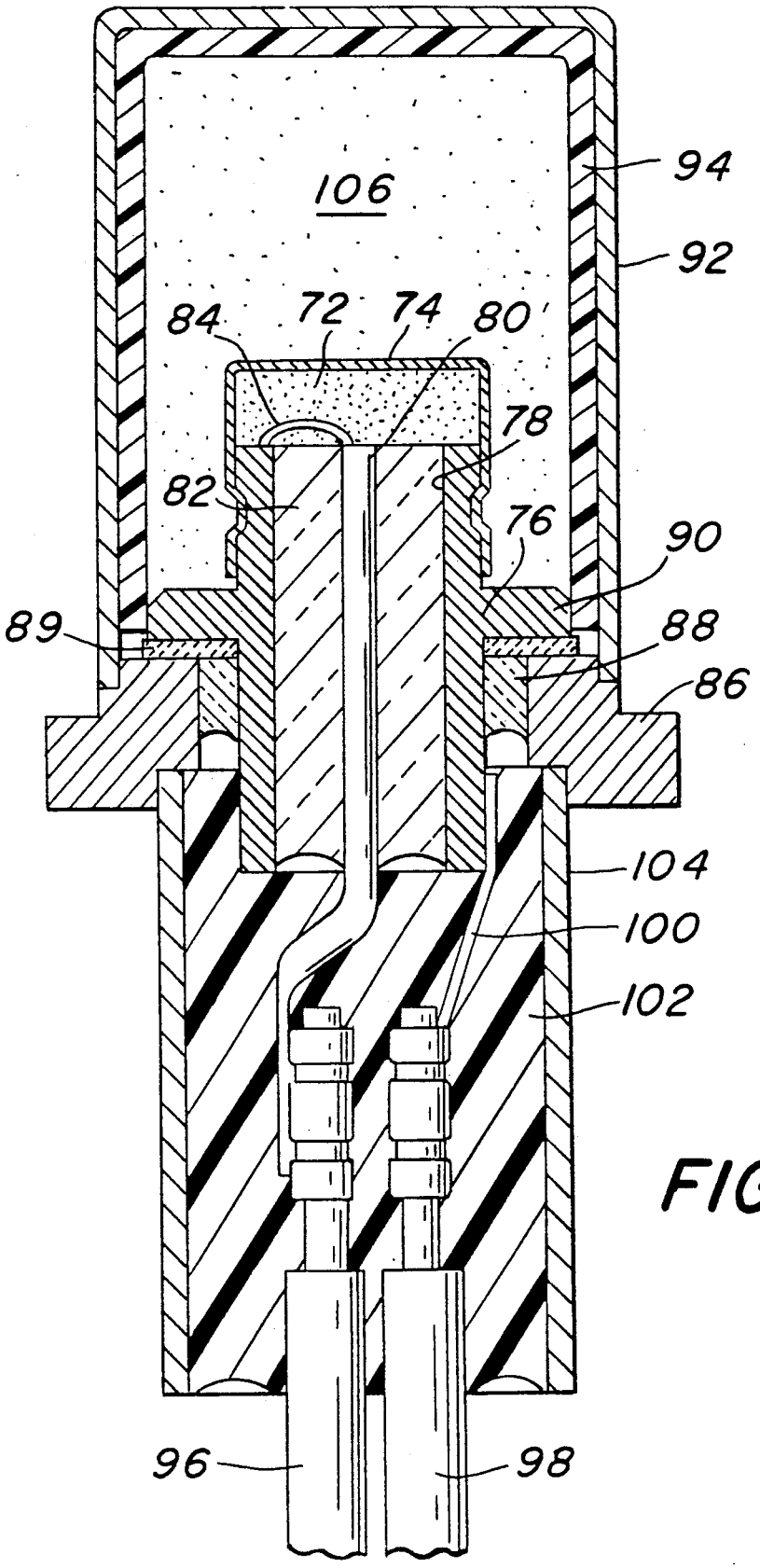
FIG. 2 is an axial section of an igniter of the coaxial type, also constructed in accordance with the invention.

In the alternative, coaxial, version of the igniter, as shown in FIG. 2, initiator charge 72 is contained in a cup 74 crimped to a first metal header 76. Header 76 has a passage 78 through which a first conductor 80 extends centrally in a first glass seal 82. The header itself acts as the other conductor, and is connected to the first conductor through bridge wire 84. The first header is spaced from an outer header 86 by a second glass seal 88, and a ceramic washer 89 is in compression between the upper face of header 86 and outwardly extending flange 90 on header 76. An output cup 92 is welded to header 86 to form a hermetic seal to prevent intrusion of moisture into the output charge during storage. The output cup is provided with an inner liner 94 containing the output charge 106. Inner conductor 80 is connected to a lead wire 96, and header 76 is connected to a lead wire 98 by a connector 100. The connections are made within a potting compound 102 in a potting sleeve 104. It will be apparent that the structure and function of the igniter of FIG. 2 are similar to those of the igniter shown in FIG. 1, the only significant difference being that one igniter is of the twinaxial type, while the other is of the coaxial type. In both cases the outer glass seal electrically isolates the outer case from the firing circuit preventing accidental ignition, and making it possible to use two-pole switching. In both cases, the use of a dual glass seal provides protection against maloperation due to gas leakage.

Various modifications can be made to the devices shown. For example, in the case of the twinaxial version, the electrical connection between the inner header and the firing circuit can be made by any suitable means so that an additional bridge wire is not required. Instead of radial output holes corresponding to hole 56 in FIG. 1, one or more holes can be provided in the end of the outer case. Different flange configurations in the outer header can be used to facilitate mounting of the igniter.

Numerous other modifications can be made to the invention described herein without departing from the scope of the invention as defined in the following claims.

I claim:

1. An electroexplosive igniter for a pyrotechnic charge comprising:

an initiator charge;

an inner case containing said initiator charge;

a first metal header fitting said inner case, and having a through passage with at least one electrical conductor extending through said passage into said inner case;

means connected to said conductor for igniting said initiator charge in response to a current in said conductor;

first glass sealing means in said passage, said glass sealing means maintaining said conductor in spaced relationship to said first header;

an outer case of electrically conductive material surrounding said inner case and spaced therefrom;

a second metal header fitting said outer case, said second header including a mounting flange, and said second header surrounding said first header and being spaced therefrom; and second glass sealing means sealing the space between said first and second headers;

whereby said outer case and said second header are electrically isolated from said first header and said inner case.

2. An electroexplosive igniter according to claim 1 having an output charge of pyrotechnic material within said outer cup but outside said inner cup.

3. An electroexplosive igniter for a pyrotechnic charge comprising:

an initiator charge;

an inner cup partially enclosing said initiator charge and having an opening;

a bridge wire in contact with said initiator charge;

a first header fitting said opening of the inner cup, and having a through passage;

means providing a pair of conductors for connecting said bridge wire to a firing circuit, at least one of said conductors extending through said passage and outward beyond said header;

first glass sealing means in said passage, said glass sealing means maintaining said conductors in spaced relationship to each other, and maintaining at least one of said conductors in spaced relationship to said first header;

means providing an electrical connection between said header and the other one of said conductors;

an outer cup of electrically conductive material surrounding said inner cup and having a central opening and at least one discharge opening;

means providing an electrically non-conductive lining in said outer cup, said lining covering each said discharge opening in the outer cup;

an electrically conductive second header fitting said central opening of the outer cup, said second header including a mounting flange, said second header surrounding said first header and being spaced therefrom; and second glass sealing means sealing the space between said first and second headers.

4. An electroexplosive igniter according to claim 3 in which both of said conductors extend through said passage in said first header and in which said first glass sealing means maintains both of said conductors in spaced relationship to said first header.

5. An electroexplosive igniter according to claim 3 in which said first header comprises a generally cylindrical body having a central axis, said body surrounding said passage and having a radially outwardly extending annular flange overlying, and axially spaced from, said second header, and an annular ceramic washer fitting between, and in contact with, said annular flange and said second header.

6. An electroexplosive igniter according to claim 3 in which said first header comprises a generally cylindrical body having a central axis, said body surrounding said passage and having a radially outwardly extending annular flange, the periphery of said annular flange being in contact with said electrically nonconductive lining in said outer cup.

7. An electroexplosive igniter according to claim 3 in which said first header comprises a generally cylindrical body having a central axis, said body surrounding said passage and having a radially outwardly extending annular flange, the periphery of said annular flange being in contact with said electrically non-conductive lining in said outer cup, and said annular flange overlying, and being axially spaced from, said second header, and including an annular ceramic washer fitting between, and in contact with, said annular flange and said second header.

8. An electroexplosive igniter for a pyrotechnic charge comprising:

an initiator charge;

an inner cup partially enclosing said initiator charge and having an opening;

a first header fitting said opening of the inner cup, and having a through passage;

a pair of conductors extending through said passage and outward beyond said header, said conductors being connectable to a firing circuit;

first glass sealing means in said passage, said glass sealing means maintaining said conductors in spaced relationship to each other and in spaced relationship to said header;

a bridge wire connected from one of said conductors to the other and located within said inner cup in close proximity to said initiator charge;

means within said inner cup providing an electrical connection between said header and one of said conductors;

an outer cup of electrically conductive material surrounding said inner cup and having a central opening and at least one discharge opening;

means providing an electrically non-conductive lining in said outer cup, said lining covering each said discharge opening in the outer cup;

an electrically conductive second header fitting said central opening of the outer cup, said second header including a mounting flange, said second header surrounding said first header and being spaced therefrom; and second glass sealing means sealing the space between said first and second headers.

* * * * *